United States Patent [19]

Nord

[11] 3,949,564

[45] Apr. 13, 1976

[54] FLOATING PLATFORMS WITH A WHARF BELONGING THERETO

[75] Inventor: Bernt Ivar Nord, Vastra Frolunda, Sweden

[73] Assignee: Ingenjorsfirma B. Nord AB, Goteborg, Sweden

[22] Filed: Oct. 29, 1974

[21] Appl. No.: 518,960

[30] Foreign Application Priority Data

Nov. 1, 1973 Sweden ..... 7314865

[52] U.S. Cl. ..... 61/46; 114/.5 F

[51] Int. Cl.[2] ..... E02D 17/00; B63B 3/02

[58] Field of Search ..... 61/46, 46.5, 63; 114/.5 D, 114/.5 F, .5 BF

[56] References Cited

UNITED STATES PATENTS

| | | | |
|---|---|---|---|
| 2,736,172 | 2/1956 | McChesney | 61/46 |
| 2,783,970 | 3/1957 | Gillespie | 61/46.5 X |
| 2,881,590 | 4/1959 | Zaskey | 61/46.5 |
| 2,979,910 | 4/1961 | Crake | 61/46.5 X |
| 3,138,932 | 6/1964 | Kofahl et al. | 61/46.5 |
| 3,355,899 | 12/1967 | Koonce et al. | 61/46.5 |
| 3,797,438 | 3/1974 | Fayren | 114/.5 D X |

*Primary Examiner*—Dennis L. Taylor

[57] ABSTRACT

The present invention relates to a floating platform arrangement with a wharf, which is provided with a number of supporting elements, whereby the platform arrangement in a portion located in its upper part and in normal working position always being above the water level in the wharf being provided with outwards projecting portions along at least two substantially opposite edges, the underside of which being provided with supporting surfaces corresponding to the supporting elements of the wharf and the platform comprising a hull, which is dimensioned in such a way that the platform arrangement can be brought into the wharf with its supporting surfaces placed at levels above the supporting surfaces of the corresponding elements and said platform arrangement being provided with pumping means so that the platform arrangement by introducing water in the hull can be brought to a hanging position in which the supporting surfaces rest against the supporting elements and by draining the water be brought to floating position whereby the platform arrangement can be used for construction purposes in its hanging position and for transportation in its floating position.

3 Claims, 3 Drawing Figures

FLOATING PLATFORMS WITH A WHARF BELONGING THERETO

The present invention relates to a floating platform arrangement with a wharf and comprising a working stage for the accomodation of objects, by way of example serving the purpose of their transportation, construction and/or mounting, and a wharf belonging thereto, which is provided with a number of supporting elements, the platform arrangement being provided with a number of supporting surfaces corresponding to the supporting elements and exhibiting a hull, which is dimensioned in such a way that at a certain load and at a certain water level in the wharf the platform arrangement can occupy a position with its supporting surfaces placed at levels above the supporting surfaces of the corresponding elements and said platform arrangement being connected to or provided with a pumping unit for introducing water into the same and in such a quantity that the platform is brought into such a position that said supporting surfaces with a predetermined minimum pressure rest upon the supporting elements, in addition to which the arrangement is connectable to or provided with a pumping unit for draining off water, whereby the platform arrangement can be brought to occupy the first mentioned position with its supporting surfaces placed at height positions above the supporting surfaces of the corresponding elements.

By big, heavy objects, which first shall be constructed and thereafter in finished condition transported long or short distances it may be of advantage, if the construction does take place directly on a pontoon or in a floating dock, which subsequently is used for the transportion. In such connection it may be suitable that a special wharf is arranged for the pontoon or the dock in which wharf said floating means by being filled with water can be lowered down on a firm foundation. In this manner one can avoid that motion of the sea, uneven distribution of the load and similar influences can cause such movements that the construction work is rendered difficult. In the French Patent specification No. 2,073,686 a floating dock of the kind mentioned is shown, said dock having a quay structure with a special bottom portion, on which the dock by being filled with water can be lowered down. A similar quay structure is described in the German Patent Publication (Offenlegungsschrift) No. 2,023,451, which quay structure is used in connection with the construction of shipsections.

However, these known arrangements have certain drawbacks. By using the bottom of the floating body as the surface to be lowered down on the supporting plane of the quay structure, the seat thus formed will be situated under the water. This of course makes the design as well as the building and maintenance of the portions in question more difficult. The access to said portions in addition will be so difficult that they hardly only with great difficulties can be equipped with any kind of levelling means. By certain types of use, especially in connection with the construction of large objects, where the horizontal line and vertical line respectively constitute the parting axis for the outline of measure and angles, it is in practice a requisite to have a working plane which is level within narrow limits.

It is an object of the present invention to eliminate said drawbacks and to provide a floating platform arrangement with a wharf belonging thereto onto which latter one the platform can be lowered down on supporting surfaces, which are located above the surface level of the water, permitting them to be designed in such a way that they can be provided with preferably automatically operating levelling means.

It is another object of the invention to provide a floating platform arrangement in which the hull can be adapted to suit its purpose to hold the arrangement floating without any consideration has to be taken to said carrying of the arrangement in resting position.

It is still a further object of the invention to provide a floating platform arrangement in which a working stage for an object which by way of example shall be mounted is adapted as to size and shape to the actual need within certain limits without taking into consideration the design of the hull supporting said stage in floating position.

It is till a further object of the invention to provide an arrangement by means of which the floating capacity of the platform can be utilized in order to reduce the load on the adjacent foundation in the wharf.

The objects of the invention are obtained by means of a platform arrangement in which a portion located in its upper part and in normal working position always being above the water level in the wharf being provided with outwards projecting portions along at least two substantially opposite edges, at the underside of which projections said supporting surfaces are located, and by the supporting elements of the wharf being arranged to project underneath the supporting surfaces of the platform, so that, when in the intended manner the supporting surfaces rest against the supporting elements, the platform is carried in hanging position.

An embodiment of the invention is illustrated in the accompanying drawings and will now be described below. In the drawings FIG. 1 shows a side-elevational view of a construction platform arrangement incorporating the features of the arrangement according to the invention;

Figure 1:
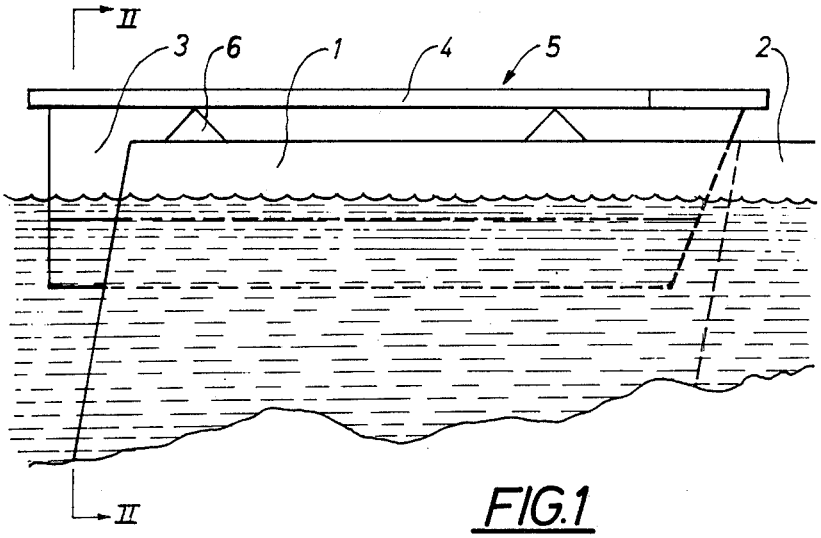
Figure 2:
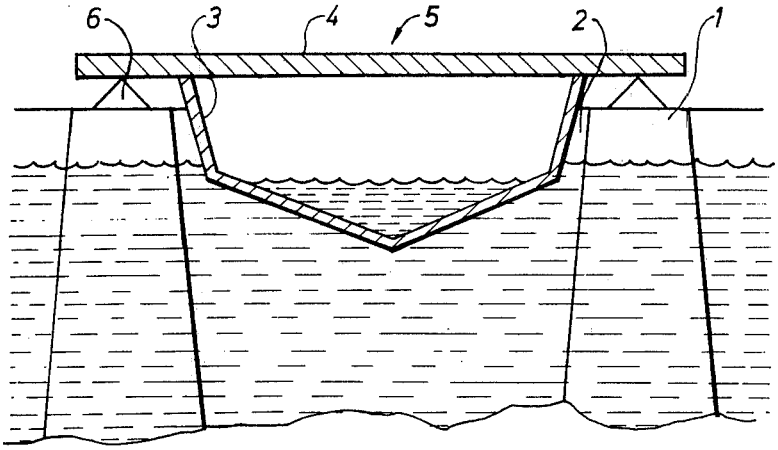
FIG. 2 illustrates a cross sectional view of said platform arrangement along the line II—II in FIG. 1.

A wharf exhibiting the shape of a U-shaped basin is shaped by two piers 1 and a quay 2. A building platform 5 provided with a buoyancy hull 3 and a working stage 4 is shaped to fit into said basin. The working stage 4 projects outside the sides of the hull 3 and to some extent reaches above the piers 1 and the quay 2.

On the piers 1 there are a number of supporting elements 6, the figures in the drawings exhibiting four, the upper end surfaces of which are located at such a height that when the edge portions (the underside of the working stage plane 4) of the platform arrangement 5 in the intended manner rest against the supporting element 6, the stage 4 is in a predetermined plane, preferably the horizontal plane.

The buoyancy of the hull 3 is dimensioned in such a way that the building platform 5 can support the greatest load intended at the lowest water level, which can be expected, at such a height level that the edges of the platform can pass over the supporting elements 6. As is evident from the schematic FIG. 3 the building platform 5 is provided with at least one motor-driven pumping unit 7 which is arranged in such a manner that water can be introduced into the hull 3 and be pumped out of the same respectively. It has been hinted in FIG.

3 that the motor-driven pumping unit 7 is provided with a reversible pump, by way of example a wing-pump and a reversible electric motor. The orifice of one tube 8 of the two connecting tubes of the pump extends downwards below the surface of the water surrounding the platform and the orifice of the other tube 9 extends downwards into the hull 3 near the bottom of the same.

Pressure feeling organs 10 for the control of the operation of the motor-driven pumping unit 7 are arranged in the supporting element 6, which organs via a central controlling unit can actuate the pumping unit 7 in such a way that water is pumped into the hull 3, when the load on the supporting elements is smaller than a certain value, while when a certain value of the pressure is exceeded, water is pumped out from the hull 3 into the surrounding water. In order to reduce the number of engagements and disengagements of the pumping unit 7, the two pressure values are suitably at a certain distance from each other. In addition the central control unit shall be arranged for a certain delay according to the start, so that changes in pressure of short duration, by way of example due to wave motion, will not cause unnecessary periods of operation for the pumping unit. The central control unit is of course also arranged for manual control of the pumping unit 7, so that water can be drained off bringing the platform in a free position relative to the supporting elements 6, when so is desired.

If an object shall be constructed, an unoccupied platform arrangement 5 and an unoccupied wharf should be available. The platform arrangement 5, the hull 3 of which has been emptied of water to such an extent that the edge portions of the working stage can pass over the supporting elements 6 are towed into the basin. Thereafter the pumping unit 7 mentioned is connected with the central control unit 11 and the automatics are switched in. As the pressure feeling organs 10 of the supporting elements 6 do not register any load in this position the pumping unit 7 will start working, so that water is pumped into the hull 3 through the tube 9 until the predetermined pressure load on the supporting elements 6 has been registered by the pressure feeling organs 10.

The construction work can now start and according to new building components being supplied to the working stage 4 the pressure load on the supporting elements 6 will increase until the predetermined highest pressure load is reached. Thereby the central control unit 11 starts the operation of the pumping units 7 and they are draining off water from the hull 3 through the tube 8 until the predetermined lowest pressure load has been restored. In the same way the pumping unit will restore the desired lowest load, if the pressure has fallen below the same, which by way of example may take place when removing a machine from the working stage in connection with the progress of a construction work.

When the object is finished, the pumping unit by manual control is brought to completely unload the supporting elements 6, so that the platform arrangement 5 can be towed out away from the wharf and be used for the subsequent transportation of the finished object to another quay, wharf, bridge building site or any other place, where the object is needed.

The lowest predetermined pressure values is chosen so that the building platform will rest very firmly on the corresponding elements and the accomodation plane will be secured in its normal position even in case of unbalancing loads. The highest pressure is chosen in such a manner that the supporting capacity of the supporting elements 6 is not jeopardized, their not being subjected to such great forces that settling phenomenons may arise, which could disturb the normal level of the working stage. The highest pressure is also adjusted relative to the rigidity of the working stage, so that not harmful stresses or deformation may take place as a result of the load between the supporting points at the supporting elements 6. The circumstance that the building platform is supported partly by the supporting elements 6 and partly by the hull 3 offers the possibility to keep stresses and deformation forces within desired limits even in case of a comparatively weak construction.

In the foregoing it has been assumed that only one single motor-driven pumping unit is installed. Several centrally controlled pumping units can of course also be installed. However, in connection with large building platforms it may be of advantage to divide the hull into several sections, each one equipped with its own pumping unit, which is separately controlled by actuation of pressure feeling organs adjacent to a corresponding supporting element or a group of such elements.

Figure 3:
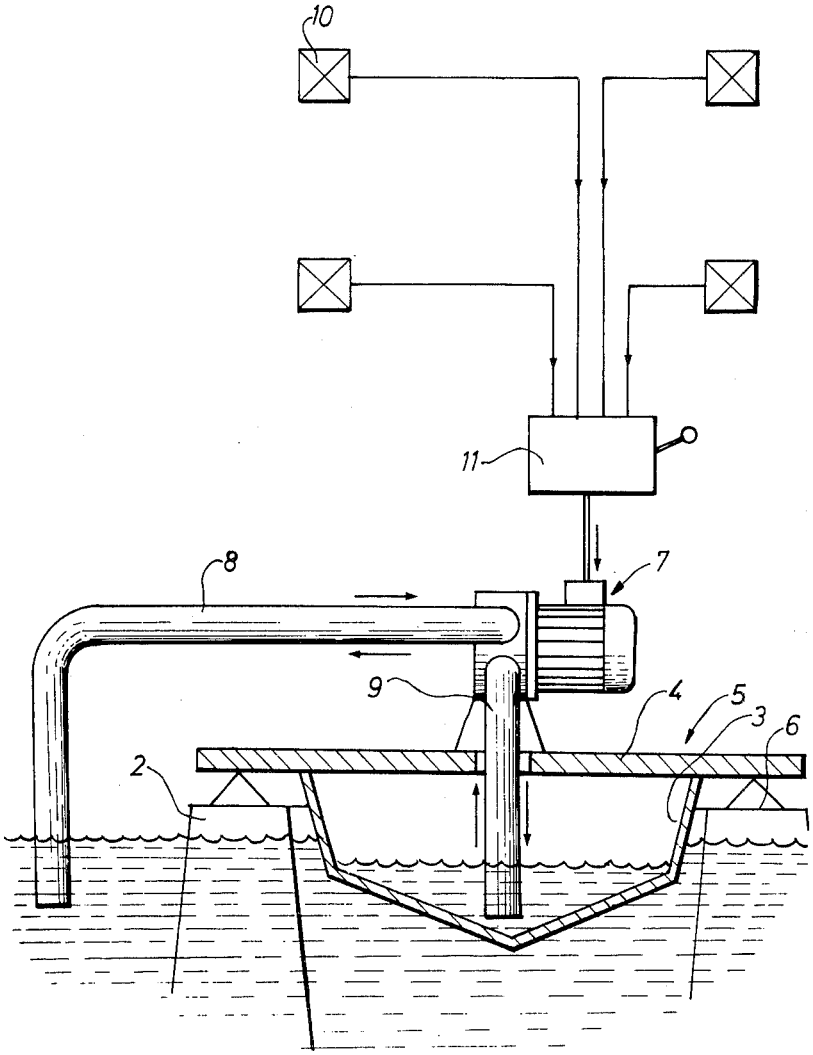
FIG. 3 shows a block diagram for the arrangement schematically placed in a section corresponding the section of FIG. 2.

In connection with a control arrangement according to FIG. 3 the central control unit 11 can suitably be arranged for some form of summing up the pressure values from the different pressure feeling organs and preferably also for a superposed control from the lowest pressure value at any of the pressure feeling organs. By such an arrangement a sufficient load pressure at all supporting points can be secured without any unnecessary high pressure forces arising.

It shall further be mentioned that the supporting elements 6 by means of their location above the water level and of their accessibility at the edge of the accomodation plane 4 are well adapted to be provided with some kind of levelling mechanism. By means of such levelling mechanism a horizontal position of the working stage which is desirable for carrying out the work on the same can always be secured even if settling phenomenons and other changes should occur. The simplest design of such a levelling arrangement could comprise a screw by means of which the contact surface of the supporting element 6 supporting the working stage can be raised and lowered. The prior art also offers the possibility of automatized arrangements, in which by way of example a hydraulic piston produces the raising and lowering respectively of the contact surfaces of the supporting element by being actuated by a position feeling organ on the working stage 4. As corresponding arrangements already are known in the prior art they will not be described more in detail here.

I claim:

1. In combination: supporting means provided with a number of spaced supporting elements above water level; and a floating platform arrangement having a hull, and a portion above said hull and projecting laterally beyond said hull, the underside of said projecting portion being provided with a number of spaced supporting surfaces corresponding in number and spacing from each other to the supporting elements, said hull being dimensioned such that at a first load and water level at said supporting means said platform arrangement occupies a first position with said supporting surfaces placed above and vertically spaced from said corresponding supporting elements, and such that at a second load and water level at said supporting means said platform occupies a second position with said supporting surfaces placed in contact with said supporting elements, and pumping means for selectively introducing water into said hull to bring said platform arrangement into said second position and for removing water from said hull to bring said platform arrangement into said first position.

2. The combination according to claim 1, comprising: pressure sensing means associated with said supporting elements and operatively connected to said pumping means, said sensing means actuating said pumping means to introduce water into said hull in response to a pressure below a minimum pressure exerted by said supporting surfaces upon said supporting elements, and to remove water from said hull in response to a pressure above a predetermined maximum pressure being exerted upon said supporting element by said supporting surfaces.

3. The combination according to claim 2, wherein said hull comprises a plurality of separate sections for receiving water, said pumping means comprising a plurality of pumps respectively associated with said plurality of sections, said supporting elements and pressure sensing means being divided into a plurality of groups respectively associated with said plurality of pumps.

* * * * *